US005411237A

United States Patent [19]

Dougherty

[11] Patent Number: 5,411,237

[45] Date of Patent: May 2, 1995

[54] GOLF CART UMBRELLA HOLDER

[76] Inventor: Robert G. Dougherty, 3551 Blue Jay Way, Eagan, Minn. 55123

[21] Appl. No.: 89,046

[22] Filed: Jul. 9, 1993

[51] Int. Cl.[6] ..... A01K 97/10

[52] U.S. Cl. ..... 248/534; 248/309.1; 224/274

[58] Field of Search ..... 248/534, 535, 536, 309.1, 248/311.2, 313, 316.1; 224/274, 915; 211/62, 63; 135/16, 19, 19.5, 21; 206/315.3, 315.8; 280/DIG. 5, DIG. 6

[56] References Cited

U.S. PATENT DOCUMENTS

| | | | |
|---|---|---|---|
| 527,032 | 10/1894 | Whiting . | |
| 664,217 | 12/1900 | Jencke et al. . | |
| 1,096,999 | 5/1914 | Burtchett . | |
| 1,296,866 | 3/1919 | Skretting . | |
| 3,178,138 | 4/1965 | Hessdoerfer et al. . | |
| 3,224,644 | 12/1965 | Davis | 248/313 |
| 3,373,911 | 3/1968 | Kebelbech | 206/315.3 X |
| 3,866,934 | 2/1975 | Brain | 280/DIG. 6 X |
| 3,943,524 | 3/1976 | Sample . | |
| 4,100,652 | 7/1978 | Carlson | 206/315.3 X |
| 4,334,692 | 6/1982 | Lynch . | |
| 4,522,300 | 6/1985 | Hamblet . | |
| 4,550,930 | 11/1985 | Proffit | 280/DIG. 6 X |
| 4,606,523 | 8/1986 | Statz et al. | 248/311.2 |
| 4,784,360 | 11/1988 | Moh | 248/311.2 X |
| 4,832,362 | 5/1989 | Chen | 280/DIG. 6 |
| 4,852,896 | 8/1989 | Milli | 206/315.3 X |
| 4,887,786 | 12/1989 | Stokes . | |
| 4,974,807 | 12/1990 | Moineau . | |
| 5,191,679 | 3/1993 | Harper | 248/311.2 X |
| 5,249,770 | 10/1993 | Louthan | 248/311.2 |
| 5,263,837 | 11/1993 | Dompe | 224/915 X |
| 5,277,211 | 1/1994 | Hendershot | 135/16 |

FOREIGN PATENT DOCUMENTS

| | | | |
|---|---|---|---|
| 117131 | of 1926 | Switzerland | 211/63 |

*Primary Examiner*—Ramon O. Ramirez
*Assistant Examiner*—Korie H. Chan
*Attorney, Agent, or Firm*—Robert C. Baker

[57] ABSTRACT

This golf cart umbrella holder is for holding an umbrella having a shaft portion and a bulging handle portion with a butt end. The holder has a vertical spine with a lower support member for supporting the handle portion, a medial gripping member for gripping the handle portion, and an upper stop member for preventing vertical removal of the umbrella from the holder. The stop member has a U-shaped slot that is sufficiently wide to receive the shaft portion but is sufficiently narrow so as to prevent upward movement of the handle portion through the slot. The holder has a ledge member for mounting the holder on a rigid frame band of a golf cart, and installation and removal of an umbrella from the mounted holder may be accomplished with one hand.

10 Claims, 1 Drawing Sheet

GOLF CART UMBRELLA HOLDER

BACKGROUND OF THE INVENTION

This invention relates to an umbrella holder, and more particularly to an umbrella holder for a golf cart.

Golfers using a hand-held umbrella during rain must repeatedly hand it to someone or find a place to temporarily rest it when taking a golf stroke. Convenience dictates that the umbrella remain in an open condition so as to avoid the necessity of repeatedly opening and closing it, but an open umbrella is vulnerable to being blown away by winds that often accompany rain.

Umbrella holders for golf carts have heretofore been proposed; but they have often employed highly complex frames Just for mounting purposes. Known umbrella holders capable of resisting wind forces (e.g., forces that tend to lift or pull an open umbrella from its holder) have required that the golfer perform several steps to install or remove the umbrella from the holder. Some designs, for example, require that straps be wrapped around the handle or shaft of the umbrella at each installation and unwrapped at each removal. These steps are most easily performed using two hands, which then requires that the golfer put down everything that he or she is carrying (e.g., a golf club) each time the umbrella is to be installed or removed from the holder.

An object of this invention is to provide a more convenient, yet effective, golf cart umbrella holder that imposes sufficient restraint upon the umbrella to resist the effects of the wind and other forces but permits the umbrella to be installed and removed from the holder using only one hand. Another object is to provide an umbrella holder having a simple and convenient means for mounting the holder on a golf cart.

SUMMARY OF THE INVENTION

The invention provides a golf cart umbrella holder. Umbrellas characteristically have a shaft portion which terminates in a bulging handle portion with a butt end. The holder of the invention includes a vertical spine with lower and upper ends, a gripping member that projects forwardly from the spine at a location between the lower and upper ends for gripping the handle portion, and a stop member that projects forwardly from the spine at the upper end. The stop member has a substantially U-shaped slot of a width for receiving the umbrella shaft portion as the umbrella handle portion is placed in the gripping member, but the width of the slot is sufficiently narrow to prevent upward movement of the handle portion through the slot.

The gripping member is most preferably comprised of laterally-spaced arms that are sufficiently distendable to embracingly receive the handle portion; but other gripping members may be useful. The holder normally will have a support member that projects forwardly from the spine at the lower end. The support member is for resting the umbrella handle butt end thereupon. The preferred support includes laterally-spaced walls for limiting lateral movement of the handle portion at the butt end.

The mounting system for fixing the holder on a golf cart most preferably comprises a ledge member that projects rearwardly from the spine at the upper end and is adapted to rest upon the horizontal upper edge of a frame band on a golf cart. A fastener at a location spaced from its upper end is employed to pull the spine into tight relationship with the band.

Still other features and details and advantages of the invention will be evident as this description proceeds.

DESCRIPTION OF THE PREFERRED EMBODIMENT

Figure 2:
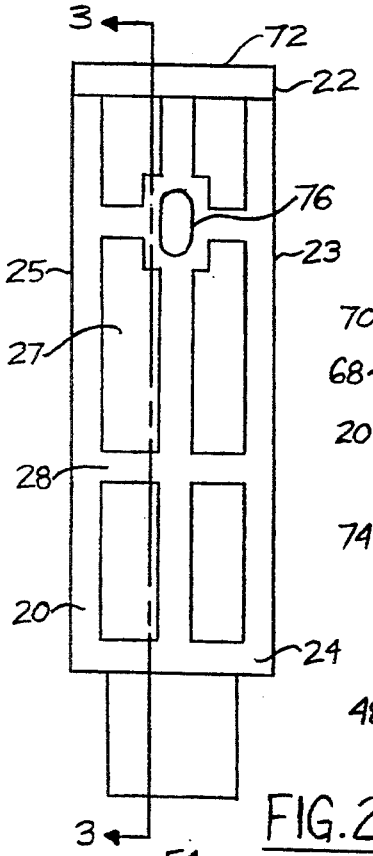
FIG. 2 a schematic plan view of the rear surface of the umbrella holder.
Figure 1:
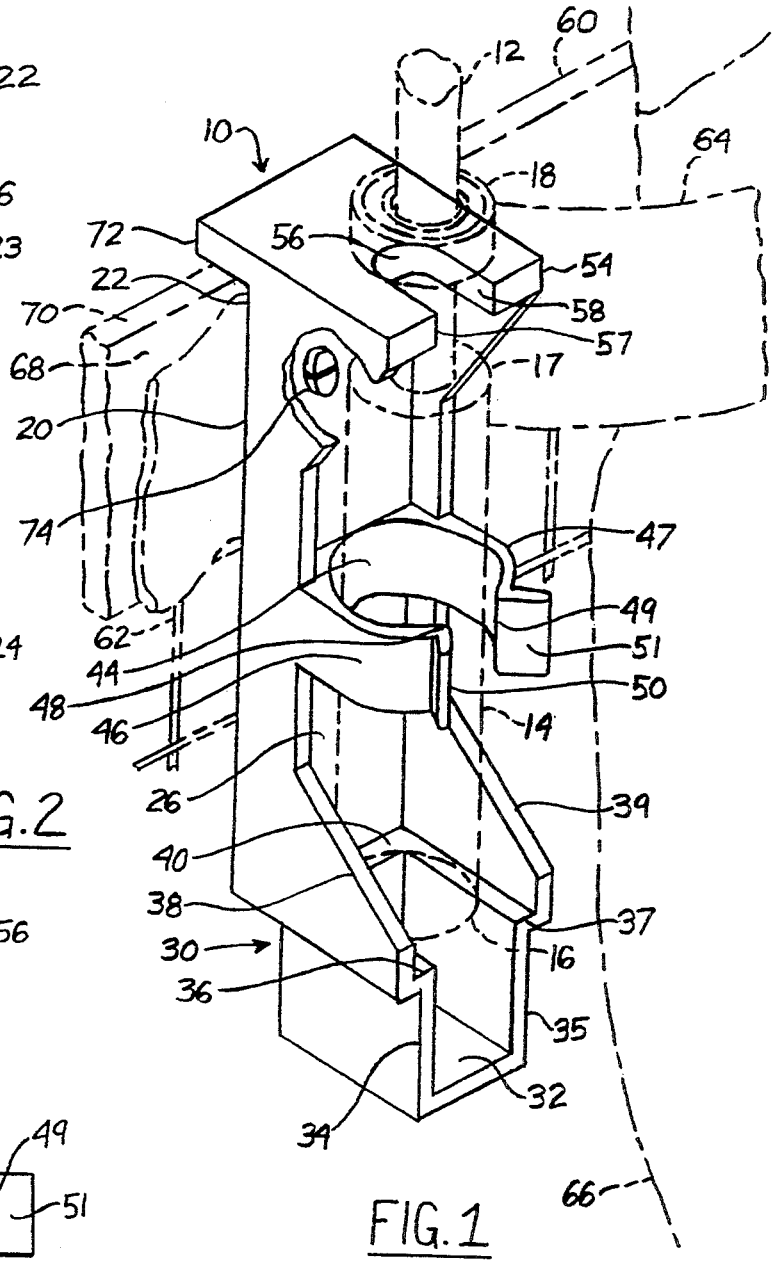
FIG. 1 is a schematic perspective view of the umbrella holder of the invention, with a portion broken away to permit clarity of showing for underlying detail, and with a phantom showing of portions of an umbrella and portions of a standard golf cart.

Referring to FIG. 1, the golf cart umbrella holder 10 of the invention comprises a spine 20 having a lower end support member 30, a medial gripping member 44 and an upper end stop member 54. This holder is styled for cooperative relationships between it and a golfer's umbrella.

A standard or conventional umbrella for golfers has fabric stretched over ribs that radiate from the top of a central mast or shaft portion 12 when the umbrella is in an unfurled or open condition and are retracted to a position parallel to the shaft portion 12 when the umbrella is in a furled or closed condition. At the bottom end of the shaft is a bulging handle portion 14, which has a head end 17 and a blunt or butt end 16. A retaining ring 18 is located near the bottom of the shaft portion 12 above the head end 17 of the handle. The ring 18 has an annular groove for receiving and securing the end tips of the retracted ribs when the umbrella is in a closed condition.

A vertically-oriented spine 20 forms the backbone of the new umbrella holder. The spine 20 has a vertical length and a lateral width. It has an upper end 22 and a lower end 24 and a width defined by the distance between its lateral side edges 23 and 25. It most preferably is a substantially planar structure having a width at least greater than one-fifth of its length. Reinforcing ribs 28 are incorporated or formed on its rear face 27 to provide strength while reducing the overall thickness and bulk required for the spine. Its front face 26 is preferably not ribbed.

The support member 30 projects from the front face 26 of the lower end of the spine and has a surface on which to rest or set the butt end 16 of an inserted handle portion. The support member 30 provides a base or bottom support for the umbrella. The preferred support member is a planar shelf-like member 32 that has an upper surface that forms a first support surface for the butt end of a relatively thin (but nevertheless bulging) umbrella handle portion.

Laterally-spaced side members or walls 34, 35 extend vertically upward from shelf 32 and limit the lateral or sideways movement of the butt end 16 of a handle portion rested on the shelf. The walls 34, 35 are preferably united to the lateral edges of both the lower section of the spine and the shelf-like member 32 to enhance the structural strength of shelf 32. Since the front of the first support surface or shelf 32 is unobstructed, the walls 34, 35 also serve as lateral guides for the handle portion as it is being inserted into the holder 10.

The most preferred support member has a second support surface for receiving larger or more bulky handle portions. This second support surface is formed by horizontal shoulders 36, 37. These shoulders are laterally spaced and located an equal distance upwardly from the first support surface 32. The shoulders 36, 37 are suitably formed by an offset in each side wall. Thus the lateral distance between the second set of side wall sections 38, 39 which extend vertically upward above the shoulders is greater than the lateral distance between the lower or first set of side wall sections 34, 35 below the shoulders. If desired, a rear or spine shoulder 40 may be formed in the front face 26 of the spine at a vertical height equal to the laterally-spaced shoulders 36, 37.

The second support surface is employed for handle portions having a width (e.g., the handle's smallest cross-sectional dimension) that exceeds the distance between the lateral shoulders 36, 37. Providing a second support surface on the holder permits the walls 34, 35 adjacent to the first support surface to be designed for a closer or snugger fit to smaller width handle portions so as to more effectively limit lateral movement or "play" of the inserted handle portion in the holder. The second support surface formed by shoulders 36, 37—plus its associated side walls 38, 39—has the capacity to support and restrict lateral movement of larger width butt ends of handle portions. Thus a wide range of handle sizes can be accommodated in the holder while at the same time retaining the functional ability of the holder to limit lateral shift of their butt ends.

Figure 3:
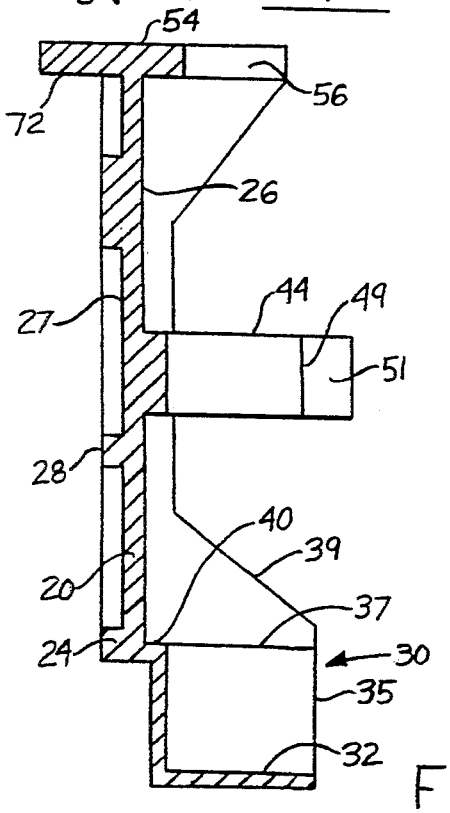
FIG. 3 a schematic sectional view of the umbrella holder taken at line 3—3 of FIG. 2.

The gripping member 44, shown in FIGS. 1 and 3, projects forwardly from the front face 26 of the spine at a location below the upper end and preferably from a medial location between the upper 22 and lower 24 ends of the spine. In the preferred embodiment, the gripping member 44 is comprised of laterally-spaced contoured or curved arms 46, 47 that project forwardly out from the spine (in rough vertical alignment with side walls 34, 35 and 38, 39). These arms 46, 47 are for embracing or encircling a section of the handle portion 14 between its head 17 and butt 16 ends. The curved arms 46, 47 terminate in distal ends 48, 49, respectively, that are laterally separated by a gap. Guide tabs 50, 51 extend laterally outward from the distal ends 48, 49, and assist or guide an umbrella handle between ends 48, 49 and through the gap into the central area of the gripping member when the umbrella handle is placed in the holder.

The arms 46, 47 of the gripping member 44 are sufficiently distendable or flexible so as to yield and increase the size of the gap between the distal ends when a handle portion is pressed against the ends. When the holder is securely mounted on a golf cart, this feature permits single-handed insertion and removal of the handle portion from the holder without requiring any action by or assistance from the golfer's other hand, leaving that hand free for other activities.

The gripping member 44 also serves to limit movement of the handle portion 14 in lateral directions. It also inhibits or resists the handle's movement in the forward direction away from the spine 20, but nevertheless permits removal of the umbrella handle portion by pulling it outward.

A significant feature of the invention is the stop member 54 which projects forwardly from the front face 26 of the upper end of the spine. The function of the stop member 54 is to block or stop the upward movement of the umbrella handle portion 14 when a wind or another lifting force is applied to an unfurled umbrella. The stop member takes advantage of a common characteristic of hand-held golf umbrellas; namely the fact that the handle portion 14 bulges or increases in size in one or more dimensions as compared to the adjacent shaft portion 12. (For example, in FIG. 1, the shaft and handle portions of an umbrella are both illustratively shown in phantom as being cylindrical, and the diameter of the handle portion at its head end is larger than the diameter of the shaft portion.)

The stop member 54 is preferably a horizontally planar rigid structure with a substantially U-shaped slot 56 formed therein for receiving the portion of the umbrella shaft proximate to the head end 17 of the handle portion. The slot 56 is formed by laterally spaced surfaces 57, 58 which are roughly aligned with the gap between the arms of the gripping member 44. Significantly, the width of the slot 56 is wide enough so that the shaft portion 12 of a conventional umbrella is easily insertable into the slot but the width is sufficiently narrow so that the bulging handle portion or head end 17 of the handle portion is unable to move through the slot. This prevents upward movement of the handle portion through the slot. The length of the slot 56 in the forwardly projecting direction (perpendicular to the spine 20) is preferably greater than the width of the slot to enhance the secureness of the shaft portion in the slot. The retaining ring 18 on the shaft portion is above or rests upon the upper surface of the stop member, but optionally may be situated below it.

A significant feature of the invention is how the various members of the holder cooperate for easy one hand installation and removal of an umbrella in and out of the holder. An umbrella handle portion 14 held in a user's hand is first guided into position by lateral walls of the support member 30 and the guiding tabs 50, 51 of the gripping member 44. The handle portion is then inserted—pushed—into the holder by applying firm pressure to the handle portion against the distal ends 48, 49 of the gripping member. This spreads the distal ends and moves the handle portion past the distal ends into the gripping member 44; and simultaneously the shaft portion is slid into the slot 56. Removal of the umbrella from the holder is achieved by simply pulling the handle portion (with a tilt of its head end away from the spine) with sufficient force to cause the distal ends of the arms to spread apart and release the handle portion. This can be accomplished with one hand (or the fingers of one hand) gripped about the part of the handle portion 14 near its head end 17 (above the gripping member 44). The umbrella shaft just above the handle portion is tilted out of the slot 56 and the handle portion is tilted out of the gripping member 44 while the butt end 16 is still supported to a degree on a support surface of support member 30, following which the umbrella is easily lifted free of the holder.

The umbrella handle and shaft portions are held in the holder against accidental removal by horizontal and vertical forces arising from average wind action during rains and average bumping action during normal golf activity.

The holder 10 is ideally mounted on the horizontally-extending rigid frame band 60 (e.g., metal or plastic) of a golf cart behind a wire basket 62 used for stowing accessories. The band 60 has a vertical face 68 and a horizontal upper edge 70. The band 60 typically has a strap 64 centrally fixed to the vertical face 68 by a keeper plate. As illustrated in FIG. 1, the holder of this invention replaces the conventional keeper plate and functions to fix strap 64 at a central location to the frame band 60. The strap 64 is used to hold a golf bag 66 against the band 60 in a conventional manner.

The preferred means for mounting the holder on the band 60 comprises a ledge member 72 that projects rearwardly from the rear face 27 of upper end of the spine 20. The ledge member 72 has a width (extending between spine sides 23 and 25) greater than the distance of its rearward projection from the spine. Further, the ledge member is shaped for resting upon the horizontal upper edge 70 of the band 60. The holder is pulled toward the vertical face 68 into a tight relationship with the band 60 by a fastener 74, such as a screw or bolt. The fastener is inserted through one or more holes such as hole 76 formed in the spine 20 at a centered or medial location between its sides and spaced downwardly from the ledge member a distance at least as great as the width of the ledge member. The holes may be spaced in vertical alignment medially between the sides of the spine 20. The fastener 74 fixes the holder 10 in place and the holder 10 fixes the strap 64 against the band 60 so that a portion of the strap 64 is held in a pinched condition between the spine 20 and band 60.

This mounting method permits simple installation of the new umbrella holder on a golf cart with a minimum of mounting hardware. The location of the holder on the golf cart next to the golf bags is especially convenient for resting an umbrella after one removes a selected golf club from the nearby bag.

Use of the holder of the invention is not limited to umbrellas having the illustrative cylindrical handle portion configuration shown in FIG. 1. The holder is also effective for handle portions having, for example, finger-contoured handles, and other styled handles.

The umbrella holder is preferably molded out of a high strength organic plastic material, although it may be formed of metal or composite materials. The necessary yieldability of the arms of the gripping member may be produced by reducing the thickness of the arms as compared to other parts of the holder. Alternatively, the gripping function of the gripping member may be produced by totally different means than the illustrated arms.

Those skilled in the art will readily recognize that this invention may be embodied in still other specific forms than illustrated without departing from the spirit or essential characteristics of it. The illustrated embodiment is therefore to be considered illustrative and not restrictive, the scope of the invention being indicated by the appended claims rather than the foregoing description; and all variations that come within the meaning and range of equivalency of the claims are intended to be embraced thereby.

That which is claimed is:

1. A golf cart apparatus for holding an umbrella having a shaft portion terminating in a bulging handle portion with a butt end, said apparatus comprising:

(i) a vertical spine having lower and upper ends, (ii) a gripping member projecting forwardly from said spine at a medial location between said lower and upper ends for gripping said umbrella handle portion, said gripping member having laterally spaced forwardly protecting arms sufficiently distendable to embracingly receive said umbrella handle portion, (iii) a support member projecting forwardly from said spine at said lower end for resting the butt end of said umbrella handle portion thereupon, (iv) a stop member projecting forwardly from said spine at said upper end, said stop member having a substantially U-shaped slot of a width for receiving said umbrella shaft portion as said umbrella handle portion is placed in said gripping member, the width of said slot being sufficiently narrow to prevent upward movement of said umbrella handle portion through said slot, and (v) means for mounting said apparatus on a golf cart having a frame band with a horizontal upper edge, said means comprising a ledge member projecting rearwardly from said spine at said upper end in opposing relationship to said forwardly projecting stop member at said upper end, said ledge member being for resting upon the upper edge of said golf cart frame band, said ledge member having a width greater than the distance of its rearward protection from said spine, said mounting means additionally comprising fastener means for pulling said spine toward said frame band, said fastener means being at a location on said spine spaced downwardly from said ledge member a distance at least as great as the width of said ledge member.

2. The holder of claim 1 wherein said slot has a length aligned in the forwardly projecting direction of said stop member, and said length is greater than the width of said slot.

3. The holder of claim 1 wherein said support member comprises a shelf-like member.

4. The holder of claim 1 wherein said support member additionally comprises laterally-spaced side members for limiting the lateral movement of said handle portion.

5. The holder of claim 4 herein each said side member comprises a wall.

6. The holder of claim 1 wherein said support member has first and second support surfaces, said first support surface comprising a shelf-like member and said second support surface comprising laterally-spaced shoulders located an equal vertical distance upwardly from said first support surface, said second support surface being for supporting the butt end of an umbrella handle portion which is larger than the space between said shoulders, and said shelf-like first support surface being below said shoulders of said second support surface, said first support surface being for supporting the butt end of an umbrella handle portion small enough to pass between said shoulders.

7. The holder of claim 6 wherein said support member additionally comprises a first set of laterally-spaced walls extending vertically upward from said first support surface for limiting lateral movement of an umbrella handle portion resting on said first support surface, and a second set of laterally-spaced walls extending vertically upward from said second support surface for limiting lateral movement of an umbrella handle portion resting on said second support surface, the lateral distance between said second set of laterally spaced walls being greater than the lateral distance between said first set of laterally spaced walls.

8. The holder of claim 1 wherein said spine has a lateral width at least greater than one-fifth of the vertical length of said spine and has reinforcing ribs on a rearward surface of said spine.

9. A golf cart equipped with an umbrella holder for holding an umbrella having a shaft portion terminating in a bulging handle portion with a butt end, said golf cart having a horizontally-extending frame band with which a strap is associated for holding a golf bag in a substantially upright position against said band, said band having a vertical face and a horizontal upper edge, said holder comprising a vertical spine having lower and upper ends, a support member projecting forwardly from said lower end for resting the butt end of an umbrella handle portion thereupon, gripping means on said spine above said support member for gripping the umbrella handle portion, and means mounting said holder on said golf cart band including a ledge member projecting rearwardly from the upper end of said spine and resting on said horizontal upper edge of said band, and a fastener disposed at a location spaced from the upper end of said spine, said fastener having means for pulling said spine into tight relationship with said band.

10. The golf cart of claim 9 wherein a portion of said strap for holding a golf bag is held in a pinched condition between said spine and said band.

* * * * *